United States Patent [19]

Wildi

[11] 4,190,934

[45] Mar. 4, 1980

[54] SEPARABLE BUCKLE

[75] Inventor: Leo J. Wildi, Radlett, England

[73] Assignee: Securiweb Limited, Bedfordshire, England

[21] Appl. No.: 912,100

[22] Filed: Jun. 2, 1978

[30] Foreign Application Priority Data

Jun. 2, 1977 [GB] United Kingdom ..... 23400/77

[51] Int. Cl.[2] ..... A44B 11/25; A44B 13/00

[52] U.S. Cl. ..... 24/77 R; 24/265 B; 24/201 R; 24/230 AL

[58] Field of Search .... 24/230 AL, 201 HE, 201 LP, 24/265 B, 201 R, 77 R

[56] References Cited

U.S. PATENT DOCUMENTS

| | | | |
|---|---|---|---|
| 2,142,770 | 1/1939 | Wied | 24/205.18 |
| 2,740,180 | 4/1956 | Nobles | 24/265 B |
| 3,227,489 | 1/1966 | Stubblefield | 24/265 B |
| 3,426,985 | 2/1969 | Pravaz | 24/205.17 |
| 3,629,910 | 12/1971 | Kirberg | 24/201 LP |
| 3,737,126 | 6/1973 | Martin | 24/230 Al |
| 3,763,523 | 10/1973 | Lindblad | 24/230 AL |

FOREIGN PATENT DOCUMENTS

| | | | |
|---|---|---|---|
| 218779 | 7/1924 | United Kingdom | 24/230 AL |

*Primary Examiner*—Bernard A. Gelak
*Attorney, Agent, or Firm*—Remy J. VanOphem

[57] ABSTRACT

A buckling assembly for a safety harness has two parts which can be connected and disconnected from one another. One of the parts has a member which must be actuated to allow connection and disconnection, and once the assembly is connected and closed, actuation of this member is prevented. Additionally, the two parts can only be separated in one relative orientation which will not be reached while the harness is being worn.

8 Claims, 6 Drawing Figures

SEPARABLE BUCKLE

BACKGROUND OF THE INVENTION

1. Field of the Invention

The present invention relates to a buckling assembly for a safety belt or safety harness.

2. Description of the Prior Art

Safety belts or safety harnesses used in industrial applications have to present a high margin of safety to comply with present day legislation. They have to be able to accept a very large loading, and in certain applications, it is important that the harness should be easy to put on and remove. Legislation on the maximum loadings to be borne by safety harnesses has driven these to be constructed as sewn-together harnesses provided with components which do not release to open the harness, but do allow for size adjustment. These harnesses are therefore continuous, and the wearer has to step into the harness and then arrange it around his body before using the components provided to tighten it around his body. Such a harness has to be tightened every time it is put on and slackened every time it is taken off. This leads to unnecessary wear on the material of the harness.

SUMMARY OF THE INVENTION

According to the present invention, there is provided a buckling assembly for a safety belt or safety harness comprising a pair of interconnectable parts respectively provided with mutually engageable members for locking the parts together, one of said members including means actuable to permit engagement or disengagement of the other member therewith, the assembly also including means for immobilising said actuable means in the engaged position of the members.

Such an assembly provides a double locking feature, because the actuable means must be operated to engage or disengage the two parts of the assembly, and once the immobilising means is in place, the actuable means cannot be operated.

BRIEF DESCRIPTION OF THE DRAWINGS

The invention will now be further described, by way of example, with reference to the accompanying drawings, in which.

BRIEF DESCRIPTION OF THE PREFERRED EMBODIMENT

Figure 1:
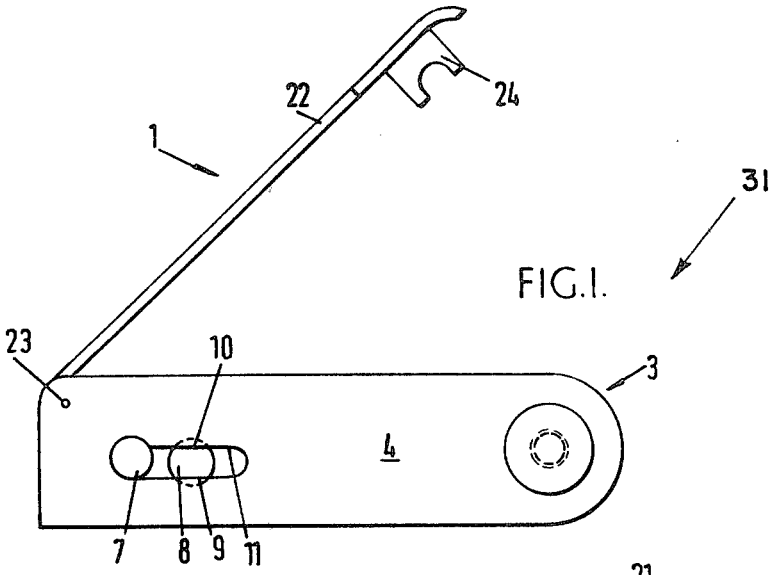
FIG. 1 is a side view of one part of an assembly according to the invention.
Figure 4:
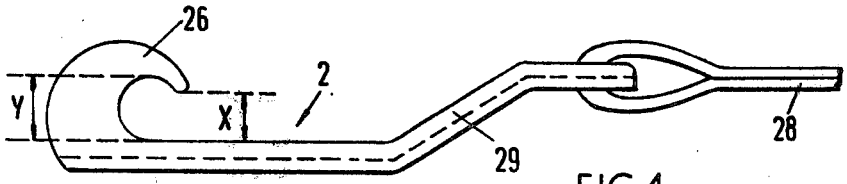
FIG. 4 is a side view of the other part of the assembly.

The two parts shown in FIGS. 1 and 4 will be referred to as the buckle 1 and the tongue 2. Opposite ends of a safety harness will be coupled to the two parts.

The buckle 1 has a steel frame 3 with side walls 4, 5 connected by a base 6. At one end of the buckle, a conventional strap adjuster is provided which consists of a stationary bar 7 fixed in side walls 4, 5 and a sliding knurled bar 8. The bar 8 is of circular cross-section, but has flats 9, 10 formed at each end so that it can slide in slots 11 in the side walls 4, 5 without rotating. A strap is threaded around these bars 7, 8 in the conventional manner which need not be described here.

At the other end of the buckle, a plunger bar 12 is provided, with which the tongue 2 will engage. The plunger bar consists of a first member 13, having a small diameter portion 14, an intermediate diameter portion 15 and a large diameter portion 16. A bore 17 is provided in the large diameter portion 16. The second plunger bar member 18 has portions 14, 15, 16 of the same diameters as the first member 13. In addition, the second member 18 has a shank 19 which is a sliding fit in bore 17. A compression spring 20 is provided in the bore 17 between the bottom of the bore and the end of the shank 19, so as to bias members 13 and 18 apart. Buttons 21 on the ends of bar 12 allow the two ends of the bar to be pushed together to a position where the small diameter portions take up the positions occupied by the intermediate diameter portions in the Figures. When the buttons are released, the plunger bar members will return to the positions shown.

Figure 2:
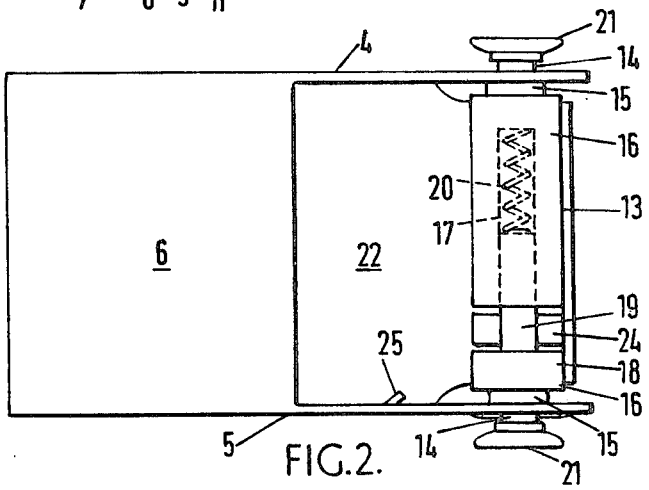
FIG. 2 is an underneath view of the part shown in FIG. 1.
Figure 3:
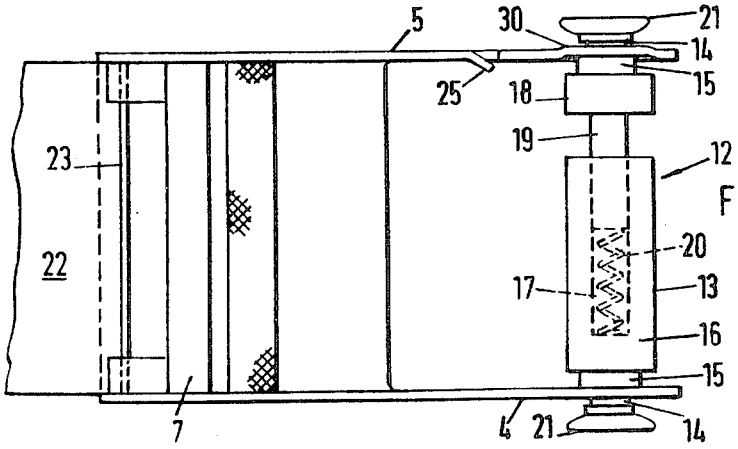
FIG. 3 is a plan view of the part shown in FIG. 1.

A plastics lid 22 is hinged at 23 between the side walls. The lid can be turned through 180° between a closed position and the position shown in FIG. 3. The lid carries a lug 24 which is a snap fit over the exposed portion of shank 19 when the plunger bar is in the position shown in the Figures. As can be seen in FIG. 2, when this lug is in position, it is impossible to compress the plunger bar by pressing the buttons 21. The lid will only close when the buckle and tongue are correctly engaged.

The tongue 2 has at either side a hook 26. Each hook 26 has a mouth of width X, and a centre of width Y. Width X is smaller than the diameter of portion 15 but larger than the diameter of portion 14, and width Y is larger than the diameter of portion 15 but smaller than the diameter of portion 16.

To connect the two parts of the assembly, the tongue is offered up to the buckle so that the mouths of the hooks bear against portions 15. The buttons 21 are then pressed, so that the portions 14 appear adjacent to the hooks, and the tongue can then be pulled into its locked position. The buttons are then released, so that portions 15 are received in the centres of the hooks 26. The hooks cannot slide off the plunger bar until the buttons 21 are pressed again, because the diameter of portions 15 is greater than the width X of the hook mouths, and once the lid 22 has been closed so that lug 24 engages shank 19, pressing the buttons 21 has no effect on the plunger bar. The assembly is thus double-locked.

A stop 25 pressed out from side wall 5 prevents the tongue being rotated about bar 12 to a position where it would force the lid up.

The tongue 2 has a slot 27 through which a webbing strap 28 can be secured. The tongue is cranked at 29, so that the pull on the strap 28 is in line with the pull exerted on the buckle 1 by a strap around the knurled bar 8.

A portion 30 of side wall 5 is bent outwards, to make it possible to remove plunger bar 12, if necessary.

The relative lengths of shank 19, bore 17 and spring 20 are such that the spring will never be fully compressed and so should not wear out.

When made of suitable high-strength materials, an assembly as described can have a breaking load of over 5,000 lb.

Figure 5:
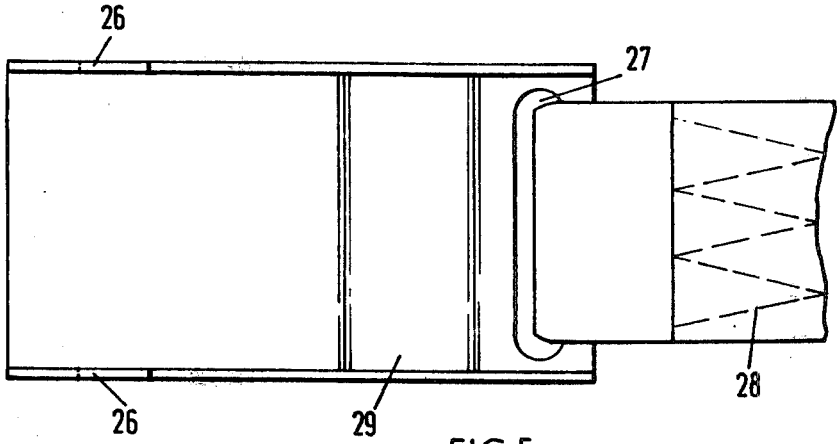
FIG. 5 is a plan view of the part shown in FIG. 4.
Figure 6:
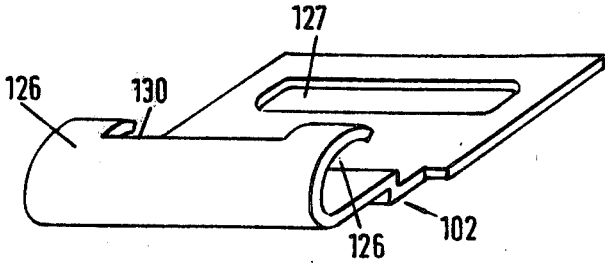
FIG. 6 is a perspective view of an alterntive type of tongue.

FIG. 6 shows an alternative form of tongue 102. This tongue is easier and cheaper to make than the tongue shown in FIGS. 4 and 5, and can also be smaller therefore reducing the overall size of the whole buckling assembly. However, it will not normally be as strong as the tongue shown in FIGS. 4 and 5, and therefore will probably be used for applications where lower loadings are likely to be encountered.

As in FIGS. 4 and 5, the tongue has a slot 127 to which a webbing strap can be secured, and hooks 126 which will engage around a plunger bar. The hooks 126 are formed by bending the end of the tongue up and over. A portion 130 of the end of the tongue is cut out between the two hooks, so that a large diameter portion of the plunger bar can be received under the cut out portion, and then can move axially outwards to engage with the two hooks 126.

The size of the base 6 and the extent of the hooks 26 in FIG. 4 are such that the two parts can only be connected or disconnected when the tongue makes an angle of about 135° to the top of the buckle. This position is shown schematically by an arrow 31 in FIG. 1. This is a position which will never be reached in normal wear, and so even if the plunger bar failed for some reason, the tongue would still not be able to come free. When it is desired to take the belt off, the tongue must be rotated to the position indicated by arrow 31 in FIG. 1. This feature can be seen as a third locking feature 9. It will be clear that the buckle according to the invention avoids the disadvantage of prior art harnesses, because length adjustment of the harness strap will not need to be made every time the harness is put on. Provided that harnesses are always used by one particular individual, the length adjustment will be set and will not need altering each time the harness is put on and the buckle assembly done up. There will therefore be less wear on the harness straps.

I claim:

1. A buckling assembly for a safety belt or safety harness, comprising:

first and second interconnectable parts;

a transverse bar on said first part;

a hook on said second part for engaging around said bar;

locating means for locating said second part relative to said first part;

a larger diameter portion and a smaller diameter portion on the transverse bar;

said hook having an opening of a width larger than the smaller diameter portion of the bar but smaller than the larger diameter portion of the bar, and a centre having a width larger than said large diameter portion;

the larger and smaller diameter portions being movable longitudinally of the bar and relative to the locating means between a first position where the smaller diameter portion registers with the hook so that the hook can be received around the bar, and a second position where the larger diameter portion registers with the hook so that the hook cannot be disengaged from the bar; and immobilising means for preventing movement of the larger and smaller diameter portions into said first position.

2. An assembly as claimed in claim 1, including spring-biassing means for biassing the bar portions into said second position.

3. An assembly as claimed in claim 2, wherein the locating means are formed by two side walls on said first part, and wherein there are two sets of larger and smaller diameter portions which are biassed apart from one another against the side walls so that the smaller diameter portions extend through the side walls in the second position, the second part having two hooks which are spaced apart by a distance such that they fit between the side walls.

4. An assembly as claimed in claim 3, wherein a further reduced diameter portion is provided on the bar between the two sets of larger and smaller diameter portions, and the immobilising means locates on said further portion to prevent the two sets of larger and smaller diameter portions from being pushed towards one another.

5. An assembly as claimed in claim 3 wherein the two sets of larger and smaller diameter portions are biassed apart by an enclosed spring.

6. An assembly as claimed in claim 1 and including a lid on said first part, the immobilising means being provided on said lid.

7. An assembly as claimed in claim 1, wherein one of the interconnectable parts includes an adjusting device for adjusting the length of a strap forming part of the harness.

8. An assembly as claimed in claim 1, wherein the two parts can only be separated in a limited range of relative orientations which will not be reached while the assembly is connected and in use.

* * * * *

UNITED STATES PATENT AND TRADEMARK OFFICE

CERTIFICATE OF CORRECTION

PATENT NO. : 4,190,934

DATED : March 4, 1980

INVENTOR(S) : Leo Joseph Wildi

It is certified that error appears in the above-identified patent and that said Letters Patent are hereby corrected as shown below:

Column 1, line 35 delete "immobilising" and insert therefore ----immobilizing----.

Column 1, line 40 delete "immobilising" and insert therefore ----immobilizing----.

Column 1, line 54 delete "alterntive" and insert therefore ----alternative----.

Column 3, line 26 after the word "feature" delete the numeral "9".

Column 4, line 2 delete "centre" and insert therefore ----center----.

Column 4, line 12 delete "immobilising" and insert therefore ----immobilizing----.

UNITED STATES PATENT AND TRADEMARK OFFICE

CERTIFICATE OF CORRECTION

PATENT NO. : 4,190,934

DATED : March 4, 1980

INVENTOR(S) : Leo Joseph Wildi

It is certified that error appears in the above-identified patent and that said Letters Patent are hereby corrected as shown below:

Column 4, line 30 delete "immobilising" and insert therefore ----immobilizing----.

Column 4, line 38 delete "immobilising" and insert therefore ----immobilizing----.

Signed and Sealed this

*Seventeenth* Day of *June 1980*

[SEAL]

*Attest:*

SIDNEY A. DIAMOND

*Attesting Officer*

*Commissioner of Patents and Trademarks*